US005330049A

United States Patent [19]

Bertelsen et al.

[11] Patent Number: 5,330,049

[45] Date of Patent: Jul. 19, 1994

[54] GARMENT BAG WITH REINFORCING MEMBERS

[75] Inventors: Jeffrey A. Bertelsen, Somerville, N.J.; Robert P. Davis, Vidalia, Ga.

[73] Assignee: Tumi Luggage, Inc., Middlesex, N.J.

[21] Appl. No.: 851,842

[22] Filed: Mar. 16, 1992

[51] Int. Cl.[5] ..... A45C 5/12; A45C 13/10; A45C 13/36

[52] U.S. Cl. ..... 206/279; 206/280; 206/287.1; 190/127

[58] Field of Search ..... 190/115, 127; 206/287, 206/287.1, 279, 280

[56] References Cited

U.S. PATENT DOCUMENTS

| | | | |
|---|---|---|---|
| 1,641,747 | 9/1927 | Doud | 206/287 |
| 1,930,043 | 10/1933 | Evens | 206/287 |
| 2,003,099 | 5/1935 | Arpin | 206/287.1 |
| 2,003,100 | 5/1935 | Arpin | 190/115 |
| 2,010,428 | 8/1935 | Finkelstein | 190/127 |
| 2,087,211 | 7/1937 | Marbury et al. | 206/287.1 X |
| 2,325,806 | 8/1943 | Simmons | 206/287.1 |
| 2,561,841 | 7/1951 | Cart | 206/287 X |
| 2,606,636 | 8/1952 | Braverman | 206/287 X |
| 2,626,689 | 1/1953 | Davis et al. | 206/287.1 |
| 2,637,424 | 5/1953 | Duskin | 206/279 |
| 2,670,854 | 3/1954 | Einhorn | 206/286 X |
| 2,774,450 | 12/1956 | Smallberg | 190/127 |
| 2,779,479 | 1/1957 | Cohen | 206/285 X |
| 3,071,220 | 1/1963 | O'Neil | 190/127 |
| 3,139,165 | 6/1964 | Taussig | 206/287.1 X |
| 3,958,675 | 5/1976 | Rosenblum | 206/287.1 |
| 4,189,036 | 8/1980 | Pelavin | 206/287.1 X |
| 4,252,220 | 2/1981 | London et al. . | |
| 4,438,844 | 3/1984 | Kesselman et al. . | |
| 4,523,678 | 6/1985 | Fox . | |
| 4,542,824 | 9/1985 | Allen . | |
| 4,598,803 | 7/1986 | Ghiassi | 206/287.1 X |
| 4,613,039 | 9/1986 | Shaw et al. | 206/287.1 |
| 4,655,343 | 4/1987 | Lane et al. . | |
| 4,693,368 | 9/1987 | King et al. . | |
| 4,736,839 | 4/1988 | King . | |
| 4,738,360 | 4/1988 | King et al. . | |
| 4,753,342 | 6/1988 | Pulichino, Jr. et al. . | |
| 4,819,796 | 4/1989 | Gerch et al. . | |
| 4,854,431 | 8/1989 | Pulichino, Jr. et al. . | |
| 5,031,734 | 7/1991 | King | 190/127 X |

FOREIGN PATENT DOCUMENTS

| | | | |
|---|---|---|---|
| 2755348 | 6/1978 | Fed. Rep. of Germany | 190/115 |
| 2118526 | 11/1923 | United Kingdom . | |
| 368184 | 3/1932 | United Kingdom | 206/292 |
| 436800 | 10/1935 | United Kingdom | 206/286 |
| 701383 | 12/1953 | United Kingdom | 206/285 |

*Primary Examiner*—Sue A. Weaver

*Attorney, Agent, or Firm*—Lerner, David, Littenberg, Krumholz & Mentlik

[57] ABSTRACT

A garment bag is provided with a single reinforcing member which extends across the top end of the bag. A carrying handle, a hanger for hanging the bag from a support, and a trolley for hanging garments within the garment bag are all connected directly to the reinforcing member so that the reinforcing member supports the entire weight of the garment bag and its contents both when the bag is hanging in an extended configuration from a support and when the bag is being carried from place to place in a folded configuration. A stiffening member which extends across the width of the bag in the bottom portion thereof and which lies adjacent the top end of the bag when the bag is in a folded configuration prevents the bottom portion of the bag from sagging to present a neat appearance. The use of a single reinforcing member enables the garment bag to be lighter in weight, easier to use and less costly to manufacture.

18 Claims, 6 Drawing Sheets

GARMENT BAG WITH REINFORCING MEMBERS

FIELD OF THE INVENTION

The present invention relates to garment bags, and more particularly, to a garment bag of the type which can be folded from an extended position into a compact configuration to facilitate carrying.

BACKGROUND OF THE INVENTION

In conventional types of foldable garment bags, garments are supported on hangers which are suspended from a bracket or what is commonly referred to in the luggage industry as a trolley disposed within the interior of the bag. These conventional garment bags typically include a rigid structural member at their upper end which provides reinforcement for supporting the trolley and the garments suspended therefrom. Such structural member is also generally used to attach an external hanger for hanging the garment bag in its unfolded condition, as well as a handle for lifting the unfolded garment bag to a hanging position. For carrying from place to place, these bags are typically folded two or three times so that they may be carried by a carrying handle attached near the middle of the bag. In order to provide a strong attachment, a second rigid reinforcing member is provided to which this carrying handle may be secured. In addition, the second reinforcing member often provides a point of secure attachment for a shoulder strap or other carrying member.

In the actual use of these conventional garment bags, there are many disadvantages associated with the presence of two rigid reinforcing members. Since these reinforcing members represent a substantial portion of the weight of the garment bag, a significant amount of unnecessary weight is added to these bags by the use of two such reinforcing members. In addition, after the bag has been folded for carrying, the carrying handle will typically be on the bottom of the bag, requiring that the bag first be turned over before it can be carried. Moreover, the presence of the additional reinforcing member and carrying handle add additional complexity and cost to the manufacture of these bags.

There therefore exists a need for a garment bag which is lighter in weight, easier to use and more cost efficient to manufacture than conventional garment bags.

SUMMARY OF THE INVENTION

These needs have now been addressed by the invention of a flexible garment bag of the type adapted to be folded from an extended configuration to a folded configuration for carrying. In accordance with one aspect hereof, the garment bag consists of a front panel, a rear panel, means for connecting the front panel in confronting relationship to the rear panel to define an enclosed garment receiving cavity, and means for providing access to the garment receiving cavity. The garment bag is provided with only a single elongated reinforcing member which extends along a top end of the bag. Connected to the reinforcing member are handle means for carrying the garment bag in the folded configuration and support means for supporting garments within the garment receiving cavity. Securing means are further provided for securing the garment bag in the folded configuration so that the bottom end of the garment bag lies adjacent the top end. The garment bag may further be provided with hanger means connected to the reinforcing member exterior of the garment receiving cavity for hanging the garment bag from a support.

In one embodiment, the garment bag further includes an elongated stiffening member secured to one of the panels, the stiffening member extending parallel to the reinforcing member but remote therefrom so that the stiffening member lies adjacent the top end of the garment bag in the folded configuration. The stiffening member is fabricated to be less rigid than the reinforcing member. In preferred embodiments, the stiffening member extends from one side edge of the garment bag to the other side edge thereof.

The securing means of the garment bag may include at least two fasteners each having a first portion and a second portion, the first portions being connected to the top end of the garment bag and the second portions being connected adjacent the stiffening member so that upon engagement of the first and second portions with one another in the folded configuration of the garment bag, forces transmitted through the fasteners to a lower region of the garment bag are not transmitted through the stiffening member. In preferred embodiments, the second portions of the fasteners are secured to the same panel as the stiffening member, between the stiffening member and the top end of the garment bag. In more preferred embodiments, the first portions of the fasteners are positioned relative to the reinforcing member so that the forces transmitted through the fasteners extend over the reinforcing member.

The stiffening member may include at least one fabric layer, a stiffening bar superposed on the fabric layer and having a first portion formed from a relatively hard material and a second portion formed from a relatively soft material, and a line of stitching extending through and joining the fabric layer and the second portion of the stiffening bar. Preferably, the stiffening member further includes at least two superposed fabric layers defining an inner edge and an outer edge of the stiffening member. The stiffening bar may then be disposed between two of the fabric layers so that the second portion lies adjacent the outer edge of the stiffening member. More preferably, the stiffening member includes a semi-rigid stiffening strip disposed between two of the fabric layers, the stiffening strip having an outer edge arranged adjacent the outer edge of the stiffening member. Desirably, the first and second portions of the stiffening bar are formed from polyvinyl chloride.

In accordance with another aspect of the present invention, the garment bag includes an elongated reinforcing member which extends along the top end of the garment bag and has connected thereto handle means for carrying the garment bag in the folded configuration and support means for supporting garments within the garment receiving cavity. An elongated stiffening member which is less rigid than the reinforcing member is secured to one of the panels and extends parallel to the reinforcing member but remote therefrom so that the stiffening member lies adjacent the top end of the garment bag in the folded configuration. This garment bag may include further reinforcing members.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF THE PREFERRED EMBODIMENTS

Figure 1:
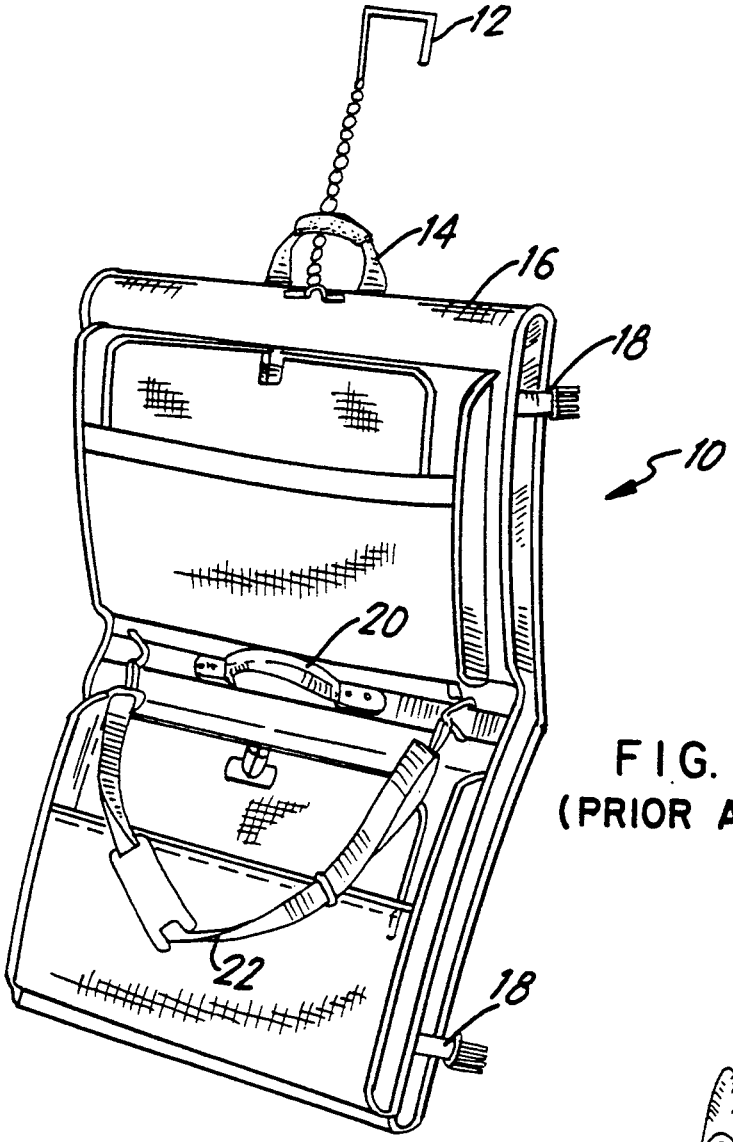
FIG. 1 (PRIOR ART)
FIG. 1 is a perspective view of a prior art garment bag in an unfolded configuration.
Figure 2:
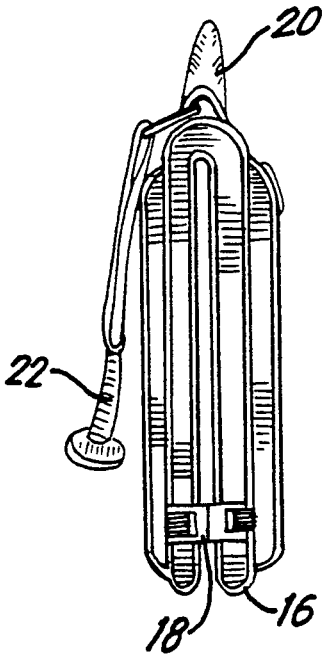
FIG. 2 (PRIOR ART)
FIG. 2 is a side elevational view of the prior art garment bag of FIG. 1 in a folded configuration.
Figure 3:
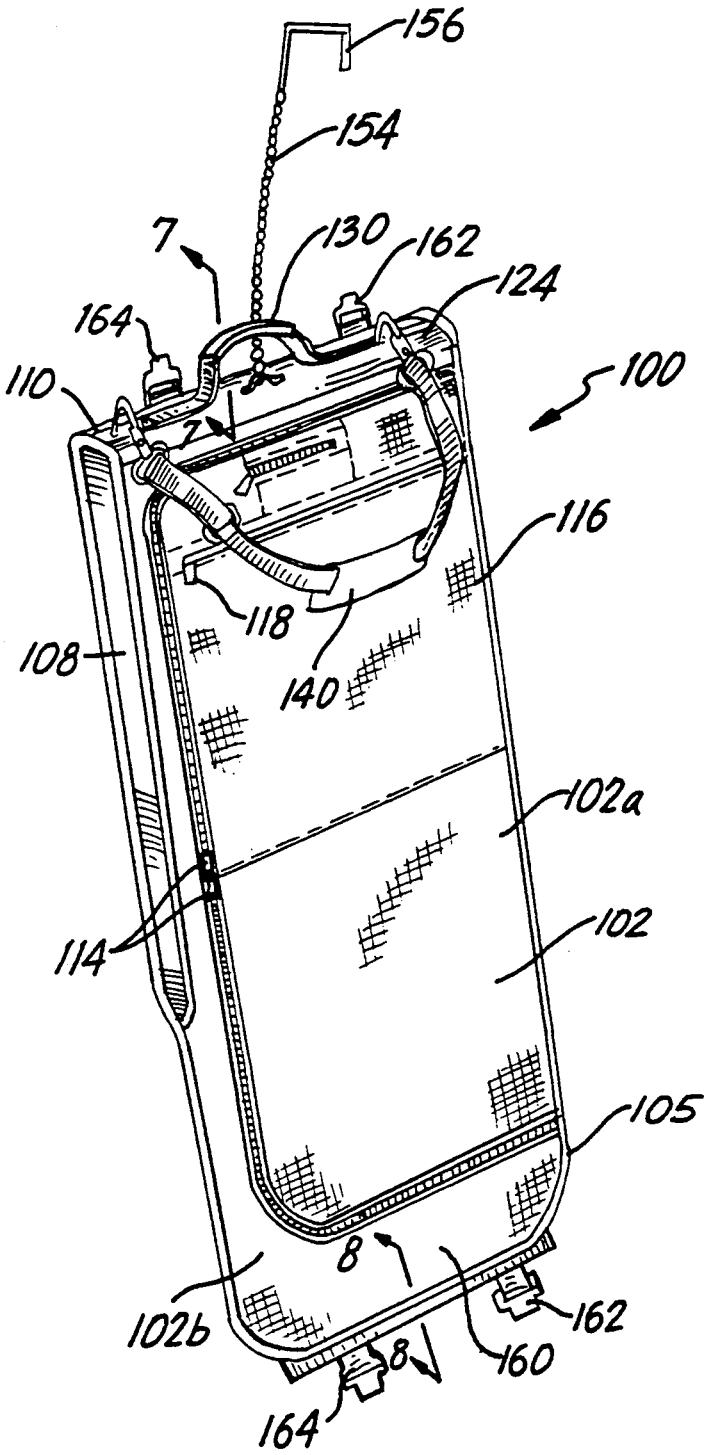
FIG. 3 is a front perspective view of one embodiment of the garment bag of the present invention in an unfolded configuration.

Referring to FIGS. 1 and 2, a prior art garment bag 10 having a conventional two-fold construction is shown. At one end, garment bag 10 is provided with a hook 12 for hanging the garment bag from a support, and a handle 14 for lifting the garment bag to its hanging position. Hook 12 and handle 14 are typically connected to a rigid reinforcing member (not shown) provided in end 16 of garment bag 10 and generally formed from metal, wood, plastic or other rigid material capable of supporting the weight of the garment bag and its contents. This reinforcing member also typically supports a trolley or other type of bracket (not shown) from which garments on hangers in bag 10 may be suspended.

For transporting from place to place, these conventional garment bags may be folded in half and secured in this configuration by fasteners 18 disposed along the side edges of the bag, all of which is shown in FIG. 2. Although not shown, longer garment bags may be folded upon themselves three times and similarly secured by fasteners arranged along the side edges and ends of the bag. A second handle 20 and a shoulder strap 22 are generally provided so that the garment bag 10 may be carried in its folded configuration. To support the weight of the garment bag and its contents as they are carried, handle 20 and shoulder strap 22 are frequently connected to a second rigid reinforcing member (not shown) which is provided near the center of garment bag 10. The need for this second reinforcing member significantly increases the complexity of these garment bags and thus the cost for manufacturing same. Moreover, the second reinforcing member makes these garment bags more heavy and cumbersome to use.

One aspect of the present invention eliminates the need for manufacturing garment bags with two such rigid reinforcing members. One embodiment of a garment bag 100 in accordance with the present invention is illustrated in FIGS. 3-6. Garment bag 100 includes a front panel 102 and a rear panel 104 which are directly connected to one another along the lower edge portion 105 of garment bag 100, while side gussets 106 and 108 and top gusset 110 interconnect these panels along the upper portion of garment bag 100. Since rear panel 104 and gussets 106, 108 and 110 form the exterior of garment bag 100 in the folded configuration, these portions are typically formed from a strong and flexible material capable of withstanding the mistreatment to which these garment bags are typically subjected during handling and use. A particularly preferred material in this regard is a heavy duty nylon fabric commonly referred to as ballistic nylon by the luggage industry. On the other hand, since front panel 102 is not exposed in the folded configuration of garment bag 100, this panel may be formed from a material which is somewhat less durable, such as a lighter weight nylon. Panels 102 and 104, along with gussets 106, 108 and 110, define an inner protective chamber 112 (FIG. 7) for storing garments. Twin zipper fasteners 114 enable a major portion 102*a* of front panel 102 to be separated from the remaining portion 102*b* to thereby provide access to inner chamber 112.

Figure 4:
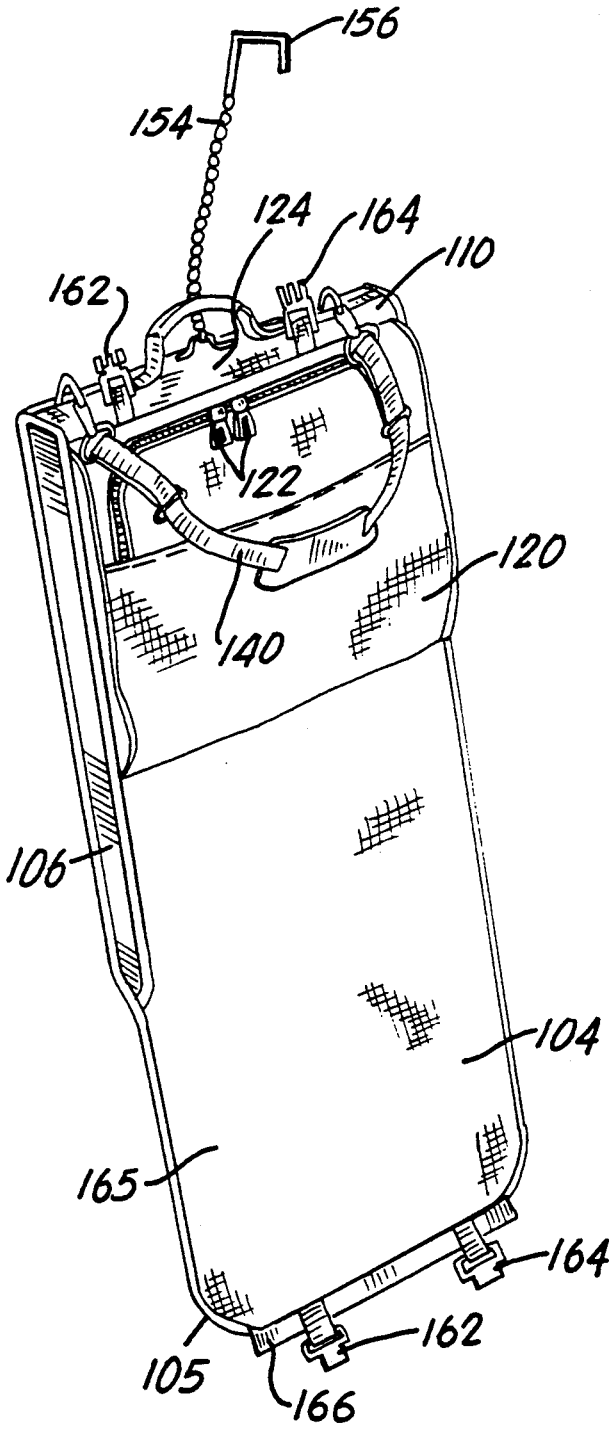
FIG. 4 is a rear perspective view of the garment bag of FIG. 3.

The front panel 102 may include one or more compartments 116 closed by zipper fastener 118 which enable articles to be stored in garment bag 100 outside of inner chamber 112. Similar zippered compartments may be formed on rear panel 104, such as compartment 120 which is closed by twin zipper fasteners 122 as shown in FIG. 4.

Figure 7:
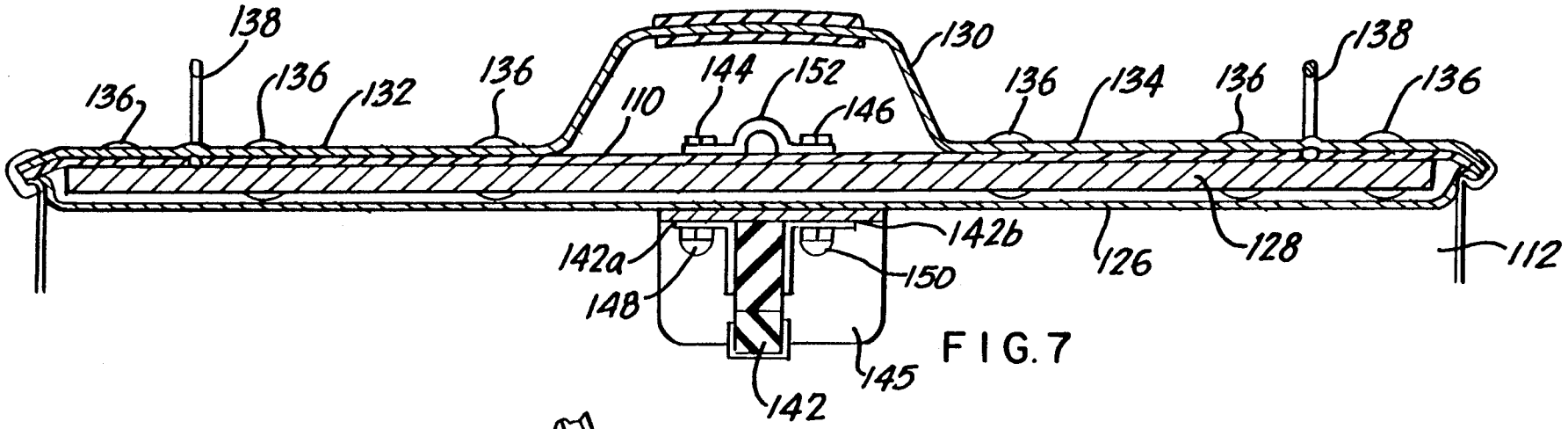
FIG. 7 is a cross-sectional view taken along line 7—7 of FIG. 3.

Extending across upper end 124 of garment bag 100 between gusset 110 a lining member 126 is a reinforcing member 128, all of which can be seen in FIG. 7. As will be discussed more fully below, garment bag 100 is constructed so that reinforcing member 128 will support the entire weight of the garment bag and its contents in both the fully extended and folded configurations. Accordingly, reinforcing member 128 is formed from a strong, substantially rigid material such as metal, wood, fiberglass, plastic or a like material capable of supporting such weight in a sturdy fashion. As used herein, the term "substantially rigid" refers to those materials which will exhibit little or no deflection when supporting the combined weight of the garment bag and its contents. One particularly preferred material in this regard is a continuous strand glass filled reinforced plastic which is strong and durable, while at the same time light in weight.

Garment bag 100 is provided on its upper end 124 with a carrying handle 130 formed from ballistic nylon or a similar strong and flexible material, the grasping portion of which is covered by a relatively stiff material such as leather. Carrying handle 130 is connected to garment bag 100 by stitching side portions 132 and 134 directly to gusset 110. Rivets 136, disposed along the upper end 124 of garment bag 100, pass through side portions 132 and 134, gusset 110 and reinforcing member 128 to securely connect carrying handle 130 to garment bag 100. A pair of rings, such as triangular rings 138, are inserted between gusset 110 and the side portions 132 and 134 on either side of carrying handle 130, each ring being disposed between a pair of rivets 136 which prevent substantial lateral movement of the rings along upper end 124. Rings 138 serve as points for attaching a shoulder strap 140 to garment bag 100.

Inside garment bag 100, the upper end 124 is further provided with a trolley 142 or other such mechanism for hanging garments on hangers within inner protective chamber 112. A protective flap 145, preferably formed from leather or some similar abrasion resistant material, partially surrounds trolley 142 to prevent the trolley from abrading or otherwise damaging the adjacent portions of front and rear panels 102 and 104, respectively. Trolley 142 is secured to reinforcing member 128 by a pair of bolts 144 and 146 which extend through gusset 110, reinforcing member 128, lining member 126, flap 145 and flange portions 142*a* and 142*b* of the trolley for threaded engagement with cap nuts 148 and 150, respectively. Bolts 144 and 146 also extend through and secure a connecting member 152 to the upper end 124 of garment bag 100. Connecting member 152 serves to attach a hanger device 154 having a hooked end 156 to garment bag 100 for suspending the garment bag from a support (not shown). By connecting each of the load-bearing elements directly to reinforcing member 128, a strong and durable connection of these elements to garment bag 100 is assured.

At its lower end 160, garment bag 100 is provided with a stiffening member 166 which is sewn or otherwise attached to rear panel 104, preferably so that it extends across substantially the entire width of the garment bag. In the folded configuration, stiffening member 166 will prevent the lower end 160 of the garment bag from sagging, and will therefore enable a neat appearance to be presented. As will be explained in more detail below, stiffening member 166 is not intended to support the weight of garment bag 100 or its contents and therefore need not be as rigid as reinforcing member 128, but rather may be formed from any material that is sufficiently rigid to support its own weight without deforming.

Figure 8:
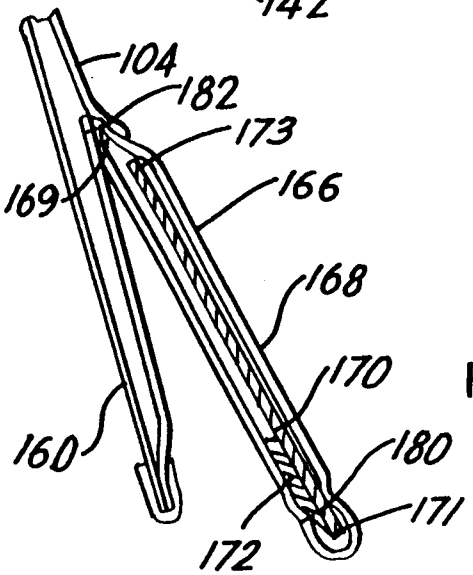
FIG. 8 is a cross-sectional view taken along line 8—8 of FIG. 3.
Figure 11:
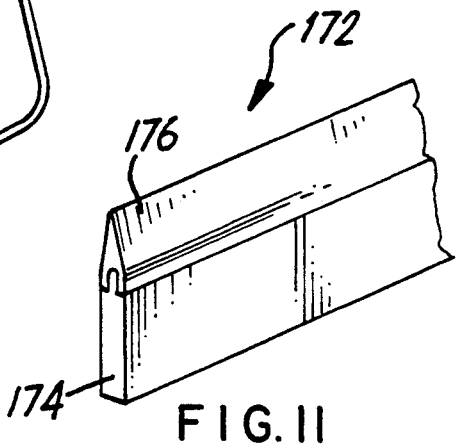
FIG. 11 is a perspective view of the semi-rigid stiffening bar employed in the garment bags of the present invention.

A preferred construction of stiffening member 166 is shown in FIG. 8. To fabricate this stiffening member, an elongated piece of ballistic nylon or other material forming rear panel 104 is folded in half lengthwise along a fold line 167 to form a sleeve 168. An elongated strip 170, desirably formed from a latex impregnated polyalymer non-woven board having a width which is less than the width of sleeve 168, is positioned in sleeve 168 so that an outer longitudinal edge 171 lies adjacent folded edge 167. The inner longitudinal edge 173 of strip 170 will then terminate at a distance from the open edge 169 of the sleeve. A dual durometer stiffening bar 172 is also positioned in sleeve 168 against strip 170 and adjacent folded edge 167. As used herein, the term "dual durometer stiffening bar" refers to a stiffening bar formed from two materials with different degrees of hardness arranged in side-by-side relationship. Thus, referring to FIG. 11, stiffening bar 172 may be fabricated by coextruding a first portion 174 alongside a second portion 176, first portion 174 being formed from a relatively hard and rigid material and second portion 176 being formed from a relatively soft and flexible material. Alternatively, stiffening bar 172 may be formed by joining together separately fabricated first and second portions 174 and 176. While the first portion 174 may be formed from any relatively hard and rigid material, such as metals, polymeric materials including plastic and rubber, fiberglass, wood and the like, the material forming second portion 176 should be sufficiently soft that it can be penetrated by a needle during a stitching process. A preferred stiffening bar 172 may be formed by coextruding a semi-rigid polyvinyl chloride having a Shore A durometer reading of about 96–98 alongside a soft polyvinyl chloride having a Shore A durometer reading of about 65. With stiffening bar 172 arranged in sleeve 168 so that the lower durometer portion 176 lies adjacent folded edge 167, sleeve 168 can be sewn along the folded edge 167 and through portion 176 and the outer longitudinal edge 171 of strip 170, as at 180, to fasten stiffening bar 172 and strip 170 to the sleeve. Stiffening member 166 can then be readily assembled to garment bag 100 by inserting the open edge 169 of sleeve 168 through a seam in rear panel 104 and sewing same along stitch line 182, beyond the inner longitudinal edge 173 of strip 170. The secure attachment of stiffening bar 172 and strip 170 to sleeve 168 prevents these elements from moving as stiffening member 166 is fastened to the garment bag.

The use of a dual durometer stiffening bar 172 greatly facilitates the assembly of stiffening member 166 to the rear panel 104 of the garment bag. In manufacturing processes employing a stiffening bar formed entirely from a rigid or semi-rigid non-stitchable material, the stiffening bar is generally held in place in the sleeve during the assembly process by gluing. However, in order to prevent the stiffening bar from becoming detached and moving within the sleeve upon subsequent use of the garment bag, an additional longitudinal line of stitching is typically sewn in the sleeve at a distance from its folded edge to retain the stiffening bar in a confined area. The foregoing assembly process employing a dual durometer stiffening bar simplifies the manufacturing process by eliminating both the gluing step and the need for this additional stitch line.

Figure 5:
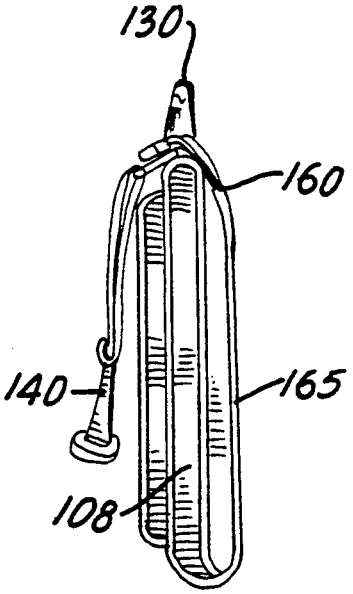
FIG. 5 is a side elevational view of the garment bag of FIG. 3 in a folded configuration.
Figure 6:
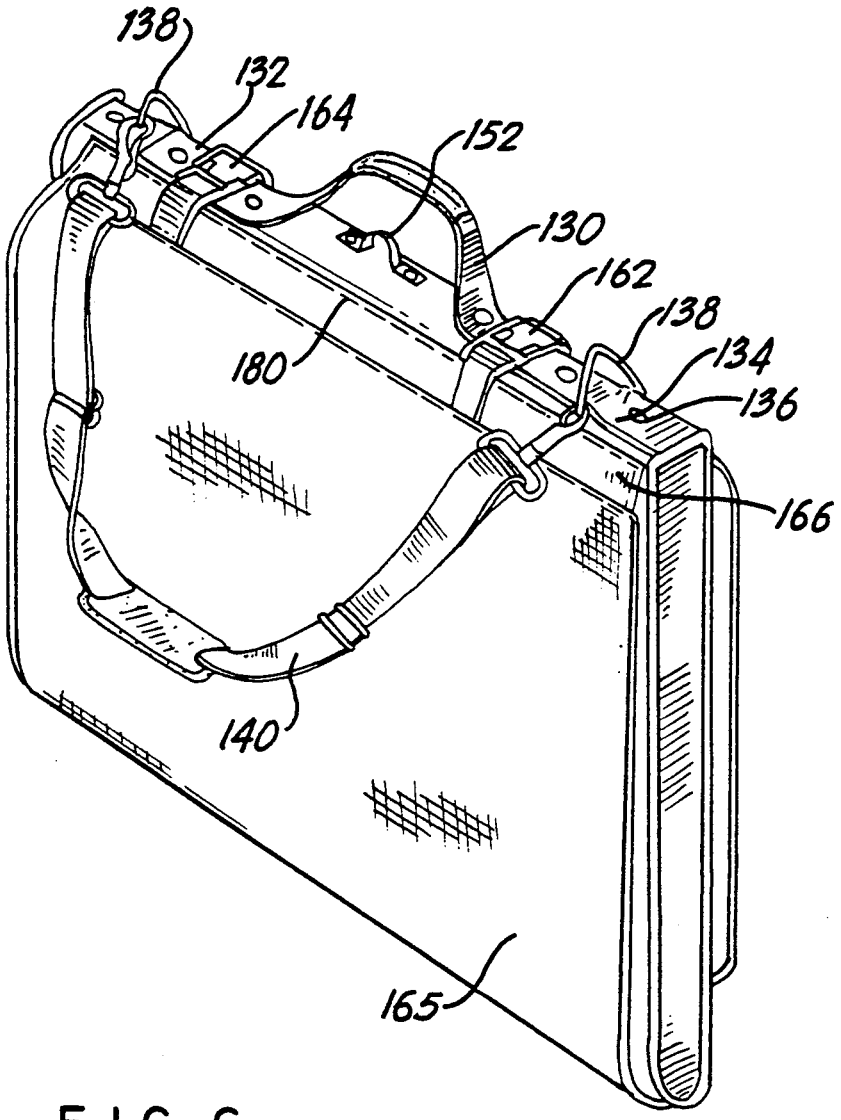
FIG. 6 is a top perspective view of the garment bag of FIG. 3 in a folded configuration.

To facilitate traveling and storage, garment bag 100 may be folded into the configuration shown in FIGS. 5 and 6 by folding a lower region 165 of the garment bag upwardly until the lower end 160 is positioned adjacent upper end 124. The opposed portions of fastening members 162 and 164 may then be connected to one another to retain the garment bag in this folded configuration. It should be particularly noted that, with garment bag 100 in the folded configuration and fastening members 162 and 164 engaged, the weight of the upwardly folded lower region 165 of the garment bag exerts a force on the upwardly folded portions of the rear panel 104 and the confronting portions of the front panel 102. These forces are transmitted through fastening members 162 and 164 which extend over the upper end 124 of the garment bag and are thus supported by the reinforcing member 128. Although stiffening member 166 is secured to rear panel 104 adjacent one portion of fastening members 162 and 164, these forces are not transmitted through the stiffening member and do not stress the stiffening member in bending.

Figure 9:
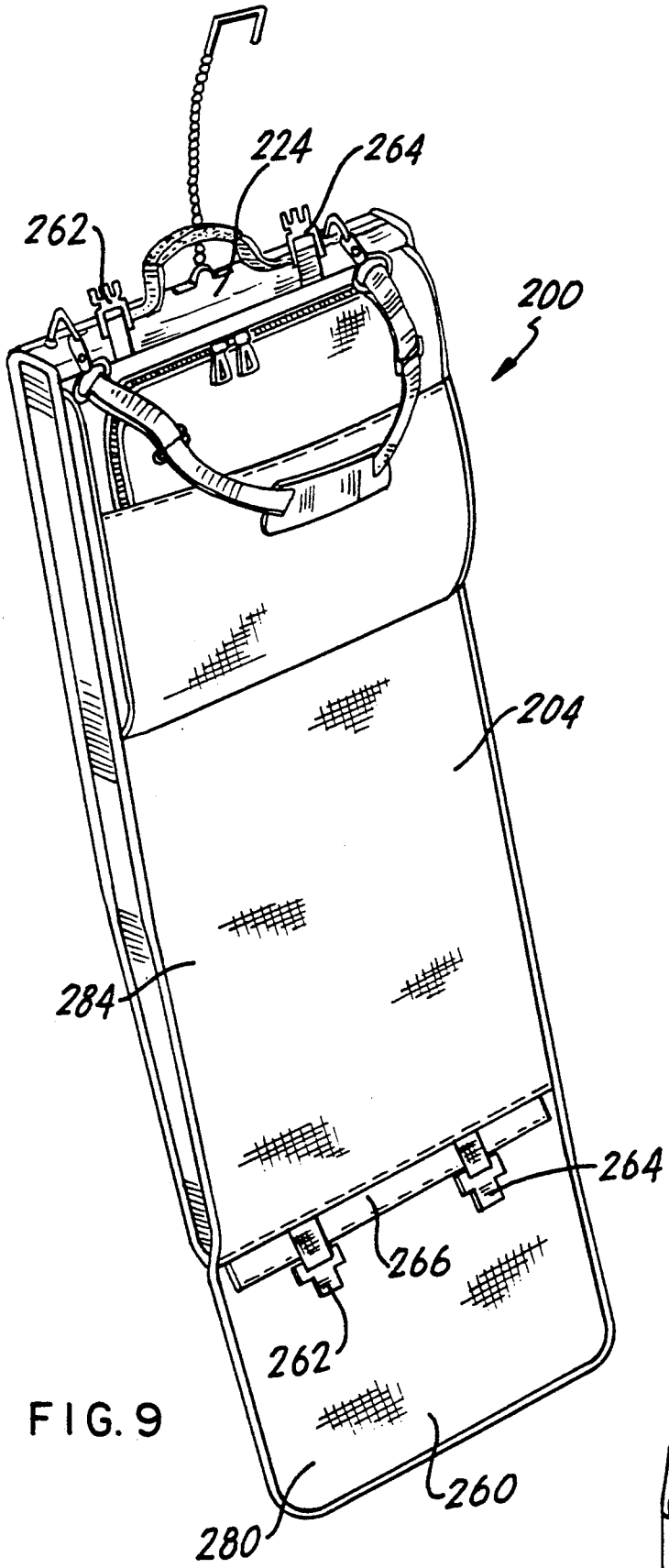
FIG. 9 is a rear perspective view of a second embodiment of the garment bag of the present invention in an unfolded configuration.
Figure 10:
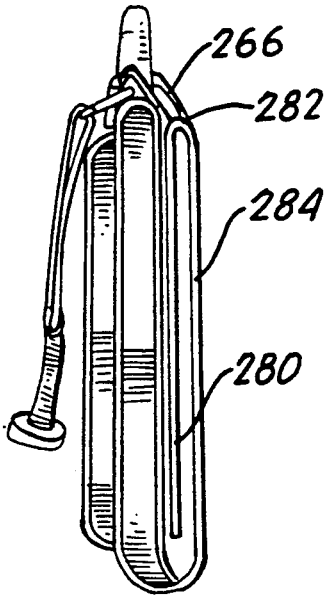
FIG. 10 is a side elevational view of the garment bag of FIG. 9 in a folded configuration.

A further embodiment of a garment bag 200 in accordance with the present invention is shown in FIGS. 9 and 10. Garment bag 200 has substantially the same construction as garment bag 100 described above, including a single reinforcing member (not shown), with the exception that garment bag 200 has a longer length than garment bag 100 for accommodating longer garments. In view of this longer length, garment bag 200 may be folded three times into a convenient size for carrying and storing. It will therefore be appreciated from the description which follows that the stiffening member 266 on garment bag 200 is attached to rear panel 204 at a greater distance from lower end 260 than is the case with garment bag 100 described above.

In folding garment bag 200 for travel, the lower region 280 of the garment bag below stiffening member 266 may be folded upwardly in the direction of upper end 224 to define a fold line 282 adjacent stiffening member 266. The intermediate region 284 of the garment bag may then also be folded upwardly by bringing fold line 282 to a position adjacent upper end 224. The garment bag may be retained in this folded configuration by connecting together the opposed portions of fastening members 262 and 264. In this folded configuration with fastening members 262 and 264 connected to one another, the combined weight of the upwardly folded lower and intermediate regions exerts forces that are transmitted through fastening members 262 and 264 which, in turn, are supported by the reinforcing member in the same fashion as described above in connection with garment bag 100. Again, these forces are not transmitted through the stiffening member 266 and do not stress the stiffening member in bending. Inasmuch as the lower region 280 is supported along fold line 282 and hangs downwardly in the carrying position of garment bag 200, there is no need for additional connecting members for holding this lower region in place. In contrast, in conventional three-fold garment bags, the lower region faces upwardly in the folded configuration and therefore must be supported by fastening members arranged on the side edges and bottom end of the bag. The need for these fastening members, in addition to the one or more fastening members for holding the top and intermediate regions of the bag together, increases the manufacturing cost of these bags and makes them more cumbersome to use.

The garment bags in accordance with preferred aspects of the present invention may always be supported from their upper end in either the folded or fully extended configurations, and therefore never need to be inverted for hanging or carrying. Not only does this feature make these garment bags much easier to use than conventional garment bags, but the garments therein have a lesser tendency to become wrinkled than with conventional garment bags.

Although the invention herein has been described with reference to particular embodiments, it is to be understood that these embodiments are merely illustrative of the principals and applications of the present invention. It is therefore to be understood that numerous modifications may be made to the illustrative embodiments and that other arrangements may be devised with departing from the spirit and scope of the present invention as set forth in the appended claims.

We claim:

1. A flexible garment bag of the type adapted to be folded from an extended configuration to a folded configuration for carrying, comprising a front panel, a rear panel, means for connecting said front panel in confronting relationship to said rear panel to define an enclosed garment receiving cavity, means for providing access to said garment receiving cavity, only one reinforcing member, said reinforcing member being elongated and extending along a top end of the garment bag, handle means connected to said reinforcing member for carrying the garment bag in the folded configuration, support means connected to said reinforcing member within said garment receiving cavity for supporting garments, an elongated stiffening member secured to one of said panels exterior of said garment receiving cavity, said stiffening member extending parallel to said reinforcing member but remote therefrom so that said stiffening member lies adjacent said top end of the garment bag in the folded configuration, said stiffening member being less rigid than said reinforcing member, and securing means for securing the garment bag in the folded configuration so that a bottom end of the garment bag lies adjacent said top end, said securing means including at least two fasteners each having a first portion and a second portion, said first portions being connected to said top end of the garment bag and said second portions being connected adjacent said stiffening member so that upon engagement of said first and second portions with one another in the folded configuration of the garment bag, forces transmitted through said fasteners to a lower region of the garment bag are not transmitted through said stiffening member.

2. The garment bag as claimed in claim 1, further comprising hanger means connected to said reinforcing member exterior of said garment receiving cavity for hanging the garment bag from a support.

3. The garment bag as claimed in claim 1, wherein the garment bag includes side edges and said stiffening member extends from one of said side edges to the other one of said side edges.

4. The garment bag as claimed in claim 1, wherein said second portions of said fasteners are secured to said one of said panels between said top end of the garment bag and said stiffening member.

5. The garment bag as claimed in claim 1, wherein said first portions of said fasteners are positioned relative to said reinforcing member so that said forces transmitted through said fasteners extend over said reinforcing member.

6. A flexible garment bag of the type adapted to be folded from an extended configuration to a folded configuration for carrying, comprising a front panel, a rear panel, means for connecting said front panel in confronting relationship to said rear panel to define an enclosed garment receiving cavity, means for providing access to said garment receiving cavity, only one reinforcing member, said reinforcing member being elongated and extending along a top end of the garment bag, handle means connected to said reinforcing member for carrying the garment bag in the folding configuration, support means connected to said reinforcing member within said garment receiving cavity for supporting garments, an elongated stiffening member secured to one of said panels exterior of said garment receiving cavity, said stiffening member extending parallel to said reinforcing member but remote therefrom so that said stiffening member lies adjacent said top end of the garment bag in the folded configuration, said stiffening member being less rigid than said reinforcing member and including at least one fabric layer, a stiffening bar superposed on said fabric layer and having a first portion formed from a relatively hard material and a second portion formed from a relatively soft material, and a line of stitching extending through and joining said fabric layer and said second portion of said stiffening bar, and securing means for securing the garment bag in the folded configuration so that a bottom end of the garment bag lies adjacent said top end.

7. The garment bag as claimed in claim 6, wherein said stiffening member includes at least two superposed fabric layers defining an inner edge and an outer edge of said stiffening member, said stiffening bar being disposed between two of said fabric layers so that said second portion lies adjacent said outer edge of said stiffening member.

8. The garment bag as claimed in claim 7, wherein said stiffening member further includes a semi-rigid stiffening strip disposed between two of said fabric layers, said stiffening strip having an outer edge arranged adjacent said outer edge of said stiffening member.

9. The garment bag as claimed in claim 6, wherein said first and second portions of said stiffening bar are formed from polyvinyl chloride.

10. A flexible garment bag of the type adapted to be folded from an extended configuration to a folded configuration for carrying, comprising a front panel, a rear panel, means for connecting said front panel in confronting relationship to said rear panel to define an enclosed garment receiving cavity, means for providing access to said garment receiving cavity, an elongated reinforcing member extending along a top end of the garment bag, handle means connected to said reinforcing member for carrying the garment bag in the folded configuration, support means connected to said reinforcing member within said garment receiving cavity for supporting garments, an elongated stiffening member secured to one of said panels, said stiffening member extending parallel to said reinforcing member but remote therefrom so that said stiffening member lies adjacent said top end of the garment bag in the folded configuration, said stiffening member being less rigid than said reinforcing member, and securing means for securing the garment bag in the folded configuration so that a bottom end of the garment bag lies adjacent said top end, said securing means including at least two fasteners each having a first portion and a second portion, said first portions being connected to said top end of the garment bag and second portions being connected adjacent said stiffening member so that upon engagement of said first and second portions with one another in the folded configuration of the garment bag, forces transmitted through said fasteners to a lower region of the garment bag are not transmitted through said stiffening member.

11. The garment bag as claimed in claim 10, further comprising hanger means connected to said reinforcing member exterior of said garment receiving cavity for hanging the garment bag from a support.

12. The garment bag as claimed in claim 10, wherein the garment bag includes side edges and said stiffening member extends from one of said side edges to the other one of said side edges.

13. The garment bag as claimed in claim 10, wherein said second portions of said fasteners are secured to said one of said panels between said top end of the garment bag and said stiffening member.

14. The garment bag as claimed in claim 10, wherein said first portions of said fasteners are positioned relative to said reinforcing member so that said forces transmitted through said fasteners extend over said reinforcing member.

15. A flexible garment bag of the type adapted to be folded from an extended configuration to a folded configuration for carrying, comprising a front panel, a rear panel, means for connecting said front panel in confronting relationship to said rear panel to define an enclosed garment receiving cavity, means for providing access to said garment receiving cavity, an elongated reinforcing member extending along a top end of the garment bag, handle means connected to said reinforcing member for carrying the garment bag in the folding configuration, support means connected to said reinforcing member within said garment receiving cavity for supporting garments, securing means for securing the garment bag in the folded configuration so that a bottom end of the garment bag lies adjacent said top end, and an elongated stiffening member secured to one of said panels, said stiffening member extending parallel to said reinforcing member but remote therefrom so that said stiffening member lies adjacent said top end of the garment bag in the folded configuration, said stiffening member being less rigid than said reinforcing member and including at least one fabric layer, a stiffening bar superposed on said fabric layer and having a first portion formed from a relatively hard material and a second portion formed from a relatively soft material, and a line of stitching extending through the joining said fabric layer and said second portion of said stiffening bar.

16. The garment bag as claimed in claim 15, wherein said stiffening member includes at least two superposed fabric layers defining an inner edge and an outer edge of said stiffening member, said stiffening bar being disposed between two of said fabric layers so that said second portion lies adjacent said outer edge of said stiffening member.

17. The garment bag as claimed in claim 16, wherein said stiffening member further includes a stiffening strip disposed between two of said fabric layers, said stiffening strip having an outer edge arranged adjacent said outer edge of said stiffening member.

18. The garment bag as claimed in claim 15, wherein said first and second portions of said stiffening bar are formed from polyvinyl chloride.

* * * * *